US010081054B2

(12) United States Patent
Ren et al.

(10) Patent No.: US 10,081,054 B2
(45) Date of Patent: Sep. 25, 2018

(54) DIE-CASTING PROCESS METHOD FOR DIE-CAST MOLDING OF METAL IN SEMI-SOLID STATE

(71) Applicant: ZHUHAI RUNXINGTAI ELECTRICAL CO., LTD, Zhuhai (CN)

(72) Inventors: Huaide Ren, Zhuhai (CN); Victor Wang, Zhuhai (CN); Gunan Li, Zhuhai (CN); Ying Zhang, Zhuhai (CN)

(73) Assignee: Zhuhai Runxingtai Electrical Co., Ltd, Zhuhai, Guangdong (CN)

( * ) Notice: Subject to any disclaimer, the term of this patent is extended or adjusted under 35 U.S.C. 154(b) by 37 days.

(21) Appl. No.: 15/512,825

(22) PCT Filed: Sep. 17, 2015

(86) PCT No.: PCT/CN2015/089861
§ 371 (c)(1),
(2) Date: Mar. 20, 2017

(87) PCT Pub. No.: WO2016/045534
PCT Pub. Date: Mar. 31, 2016

(65) Prior Publication Data

US 2017/0291218 A1 Oct. 12, 2017

(30) Foreign Application Priority Data

Sep. 23, 2014 (CN) ..... 2014 1 0492077

(51) Int. Cl.
*B22D 17/00* (2006.01)
*B22D 17/08* (2006.01)
(Continued)

(52) U.S. Cl.
CPC ..... *B22D 17/007* (2013.01); *B22D 17/08* (2013.01); *B22D 18/02* (2013.01); *C22C 21/04* (2013.01)

(58) Field of Classification Search
CPC ..... B22D 17/007; C22C 21/04
See application file for complete search history.

(56) References Cited

U.S. PATENT DOCUMENTS 5,925,315 A * 7/1999 Bourkhina ..... C22C 21/02 420/530
7,152,658 B2 12/2006 Hartmann et al.
(Continued)

FOREIGN PATENT DOCUMENTS

CA 2459677 A1 2/2003
CN 1416982 A 5/2003
(Continued)

OTHER PUBLICATIONS

Written Opinion for PCT/CN2015/089861 dated Dec. 28, 2015 and its English machine translation provided by WIPO Patentscope.
(Continued)

*Primary Examiner* — Kevin E Yoon
(74) *Attorney, Agent, or Firm* — Ladas & Parry, LLP

(57) ABSTRACT

A die-casting process method for die-cast molding of a metal in a semi-solid state, wherein a semi-solid state die-casting machine is used as a processing device and a pulper is used as a device for preparing and delivering a slurry in a semi-solid state; the method comprises the steps: spraying a mold release agent and mold clamping; melting the raw material and keeping the temperature; adding a metal modificator into the molten raw material to prepare the slurry in a semi-solid state; transferring the slurry in a semi-solid state into a mold by the pulper; die-casting, opening the mold and exporting a die-cast; removing the sprue to obtain the final die-cast. In the process method, a metal modificator is added
(Continued)

to the liquid metal raw material during the preparation of the slurry in a semi-solid state so as to generate more crystal nuclei, so that die-cast products have better mechanical properties; by way of die-casting the slurry in a semi-solid state, during mold stripping the die-cast is low in temperature and small in deformation quantity, and the best shapes and surface smoothness of the product can be guaranteed; and the die-cast is compact interiorly with producing air holes, and the best interior structure and mechanical properties of the die-cast product are guaranteed.

5 Claims, 1 Drawing Sheet

(51) Int. Cl.
*B22D 18/02* (2006.01)
*C22C 21/04* (2006.01)

(56) References Cited

U.S. PATENT DOCUMENTS

| | | | | |
|---|---|---|---|---|
| 7,509,993 | B1 | 3/2009 | Turng et al. | |
| 2003/0037900 | A1 | 2/2003 | Winterbottom et al. | |
| 2003/0196775 | A1 | 10/2003 | Kamm et al. | |
| 2008/0159906 | A1* | 7/2008 | Suganuma | B22D 17/007 420/590 |
| 2012/0000578 | A1* | 1/2012 | Wang | C22C 21/02 148/549 |

FOREIGN PATENT DOCUMENTS

| | | | |
|---|---|---|---|
| CN | 1994622 | A | 7/2007 |
| CN | 101007342 | | 8/2007 |
| CN | 101229582 | | 7/2008 |
| CN | 101537480 | | 9/2009 |
| CN | 101537480 | A | 9/2009 |
| CN | 101602099 | | 12/2009 |
| CN | 101817064 | A | 9/2010 |
| CN | 102634700 | A | 8/2012 |
| CN | 103173663 | A | 6/2013 |
| CN | 104259417 | A | 1/2015 |
| CN | 104259418 | A | 1/2015 |
| WO | 2005056845 | A2 | 6/2005 |

OTHER PUBLICATIONS

U.S. Appl. No. 15/511,457, filed Mar. 15, 2007, Ren et al.
International Search Report for PCT/CN2015/089861 dated Dec. 28, 2015 and its English machine translation provided by WIPO.
Written Opinion for PCT/CN2015/089861 dated Dec. 28, 2015 and its English machine translation by Google translate.
International Search Report for PCT/CN2015/089859 dated Nov. 28, 2015 and its English machine translation provided by WIPO.
Written Opinion for PCT/CN2015/089859 dated Nov. 28, 2015 and its English machine translation by Google translate.
From CN201410492077.5, 1st Office Action, dated Sep. 10, 2015, and its English translation from Espacenet.
From CN201410492077.5, 1st Search Report, dated Sep. 24, 2015.
Written Opinion of the International Searching Authority for PCT/CN2015/089861 dated Dec. 28, 2015, and its official English translation from WIPO.
International Preliminary Report on Patentability (Chapter I) for PCT/CN2015/089861 dated Mar. 28, 2017, and its official English translation from WIPO.
Written Opinion of the International Searching Authority for PCT/CN2015/089859 dated Dec. 28, 2015 and its official English translation from WIPO.
International Preliminary Report on Patentability (Chapter I) for PCT/CN2015/089859 dated Mar. 21, 2017, and its official English translation from WIPO.
Wu, Shusen et al., Machinist Metal Forming, "Semi-solid Die-casting Forming Technique for High Silicon-aluminum Alloy", No. 9, Dec. 31, 2010, ISSN: ISSN 1674-165X. English translation provided by applicant.

* cited by examiner

DIE-CASTING PROCESS METHOD FOR DIE-CAST MOLDING OF METAL IN SEMI-SOLID STATE

CROSS-REFERENCE TO RELATED APPLICATION

This application is the U.S. National phase of PCT Application No. PCT/CN2015/089861 filed on Sep. 17, 2015, which claims a priority to the Chinese Patent Application No. 201410492077.5, filed on Sep. 23, 2014, the disclosures of which are hereby incorporated by reference in their entireties.

TECHNICAL FIELD

The present invention relates to a die-casting process method of metal, and in particular to a die-casting process method for die-cast molding of semisolid metal.

BACKGROUND ART

An ordinary high-speed high-pressure injection molding process requires fast mold filling of molten aluminum at a high temperature of about 680° C. During the molding, it is likely to cause internal shrinkage cavity and pore defects due to air entrapment, and accordingly, it is likely to cause poor air tightness in a casting when processed and assembled. After being molded by die-casting, a product is subject to significant thermal deformation during cooling, and the deformation of a die-cast blank can reach about 2 mm. During the cleaning, manual sizing is required to guarantee the planarity that is necessary to the subsequent processing, thus resulting in difficulties in processing and positioning and also adversely impacting the quality and accuracy of the product.

At present, products prepared by ordinary die-casting processes are instable in internal quality, and the assembled products with poor air tightness take share of about 10%. The cleaning of the die-casts is highly labor intensive and it is difficult to guarantee the appearance quality. This becomes a bottleneck procedure for die-casting production and restricts the rapid development of the die-casting industry.

Contents of the Present Invention

A technical problem to be solved by the present invention is to overcome the defects of the prior art, and to provide a die-casting process method for die-cast molding of semisolid metal. With regard to this method, by die-casting of the semisolid slurry, the die-cast product is compact interiorly, without any pores formed, the deformation of a die-cast blank is extremely small, complex surface treatment is not required for the die-cast, and the best quality and performance of the product can be guaranteed.

The present invention provides a die-casting process method for die-cast molding of semisolid metal. In the die-casting process method, a semisolid die-casting machine is used as the processing device, and a pulper is used as the device for preparing and delivering semisolid slurry; the device layout of the die-casting process method is as follows: the pulper is arranged on the left side of the semisolid die-casting machine, a sprayer configured to spray mold release agent to a mold is arranged on the right side of the semisolid die-casting machine, and an extractor configured to extract a die-cast out of the mold is arranged on the front side of the semisolid die-casting machine; the right side of the extractor is coordinated with a conveyor belt, an operating bench is arranged at the right end of the conveyor belt, and an oil press configured to stamp to remove a sprue on the die-cast is provided on the operating bench; and the die-casting process method includes the steps of:

(1) mounting the mold on the semisolid die-casting machine, spraying the mold release agent onto the surface of the mold with the sprayer, and then closing the mold;

(2) melting metal raw material with a heating furnace, and putting the liquid metal raw material into a holding furnace for storage, wherein the metal raw material is a metal raw material of aluminum alloy;

(3) preparing semisolid slurry from the liquid metal raw material in the holding furnace by the pulper;

(4) conveying the semisolid slurry into the mold of the semisolid die-casting machine by the pulper;

(5) die-casting by the semisolid die-casting machine, and then opening the mold, extracting the die-cast out of the mold with the extractor, and exporting the die-cast by placing it on the conveyor belt; and (6) conveying the die-cast to the operating bench by the conveyor belt, and stamping to remove the sprue on the die-cast by the oil press to obtain the final die-cast product.

Wherein, in the step (5), the semisolid die-casting machine is a 1000T horizontal cold chamber die-casting machine, with a die-casting temperature of 586° C. to 594° C., a die-casting speed of 4.2 m/s, a system pressure of 15.5 MPa, and a boost pressure of 29 MPa.

Wherein, in the step (3), mass percentages of the components in the liquid metal raw material are: 6-7.5% of silicon, 0.3-1.7% of copper, 0.2-2.5% of zinc, 0.4-2.2% of nickel, 0.2-0.7% of magnesium, 0.2-1.3% of iron, with the balance of aluminum.

Wherein, in the step (3), a method for preparing the semisolid slurry by the pulper comprises the steps of: keeping the temperature of the liquid metal raw material in the holding furnace 12° C. to 23° C. higher than its liquidus; placing the molten metal raw material in the holding furnace into a ladle by the pulper, then placing a solid metal modifier into the ladle, and the metal modifier in the ladle being melted after absorbing the heat of the liquid metal raw material, thus to cool the liquid metal raw material and generate a large number of crystal nuclei, to obtain the semisolid slurry; and blowing, at a speed of 13 L/min, argon gas into the metal raw material in the ladle while adding the metal modifier, to accelerate mixing and cooling, wherein the dosage of the metal modifier is 1.5% to 3.8% of the mass of the metal raw material in the ladle.

Wherein, the components of the metal modifier are the same as those of the liquid metal raw material.

Wherein, the metal modifier comprises the following components: silicon, copper, manganese, magnesium, zinc, titanium, lead and aluminum, at a mass ratio of (6.55 to 6.90):(0.22 to 0.85):(0.003 to 0.008):(0.15 to 0.75):(0.03 to 0.075):(0.06 to 0.1):(0.03 to 0.05):(91.7 to 92.8).

Wherein, the metal modifier comprises the following components: silicon, copper, manganese, magnesium, zinc, titanium, lead and aluminum, at a mass ratio of 6.70:0.57:0.007:0.38:0.047:0.08:0.04:92.5.

According to the above technical solution, the following beneficial technical effects can be found.

(1) With regard to the die-casting process method for die-cast molding of semisolid metal of the present invention, by die-casting of the semisolid slurry, the die-cast product is compact interiorly, without any pores formed, and the best interior structure and mechanical properties of the die-cast product are guaranteed, and the quality of the product is guaranteed.

(2) With regard to the die-casting process method for die-cast molding of semisolid metal of the present invention, by die-casting of the semisolid slurry, compared with the traditional high-speed high-pressure injection molding process, the die-cast, when extracted out of the mold, is lower in temperature, and the die-cast blank, when extracted out of the mold, has a certain mechanical strength. In contrast, a die-cast, prepared by the traditional liquid die-casting processes, when extracted out of the mold, has a higher temperature and is likely to deform when extracted out of the mold. The deformation of the die-cast blank of the present invention is extremely small, and complex surface treatment is not required for the die-cast, so that the best shape and surface smoothness of the product can be guaranteed.

(3) With regard to the die-casting process method for die-cast molding of semisolid metal of the present invention, by a semisolid die-casting process, the die-cast product has many spherical crystals and the die-casting has better mechanical properties.

DETAILED DESCRIPTION OF THE EMBODIMENTS

Figure 1:
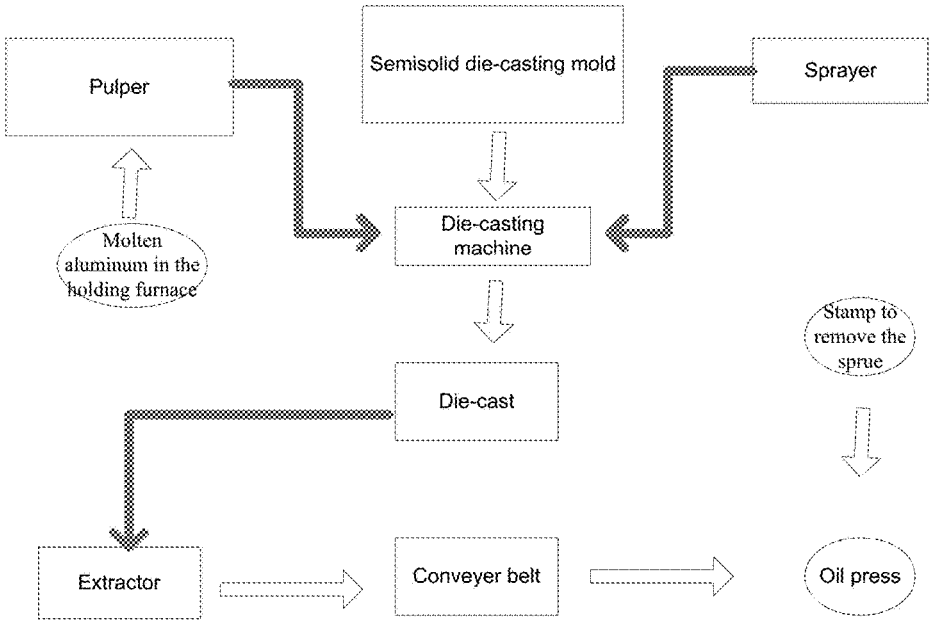
FIG. 1 is a schematic diagram of an device layout of a die-casting process method for die-cast molding of semisolid metal of the present invention.
Figure 2:
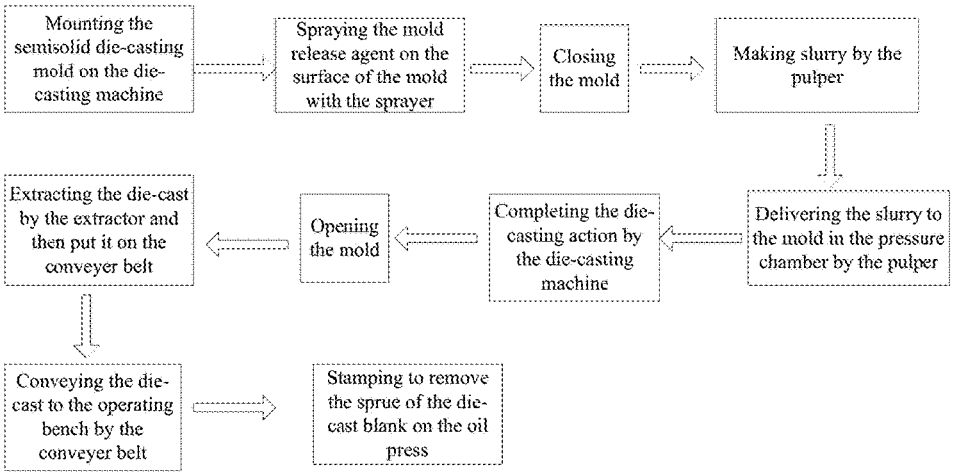
FIG. 2 is a flow diagram of the die-casting process method of the present invention.

In order to make the objectives, technical solutions and advantages of the present invention clearer, the present invention will be further described in detail by way of Examples.

EXAMPLE 1

A technical solution employed by the present invention is a die-casting process method for die-cast molding of semisolid metal. In the die-casting process method, a semisolid die-casting machine is used as the processing device, and a pulper is used as the device for preparing and delivering semisolid slurry; the device layout of the die-casting process method is as follows: the pulper is arranged on the left side of the semisolid die-casting machine, a sprayer configured to spray a mold release agent to a mold is arranged on the right side of the semisolid die-casting machine, and an extractor configured to extract a die-cast out of the mold is arranged on the front side of the semisolid die-casting machine; the right side of the extractor is coordinated with a conveyor belt, an operating bench is arranged at the right end of the conveyor belt, and an oil press configured to stamp to remove a sprue on the die-cast is provided on the operating bench;

The die-casting process method comprises the steps of:

(1) mounting the mold on the semisolid die-casting machine, spraying the mold release agent onto the surface of the mold with the sprayer, and then closing the mold;

(2) melting metal raw material with a heating furnace, and putting the liquid metal raw material into a holding furnace for storage, where the metal raw material is a metal raw material of aluminum alloy;

(3) preparing semisolid slurry from the liquid metal raw material in the holding furnace by the pulper; placing the molten metal raw material into a ladle by the pulper, then placing a solid metal modifier into the liquid metal raw material in the ladle, thus to cool the liquid metal raw material and generate a large number of crystal nuclei, to obtain the semisolid slurry, where mass percentages of the components in the liquid metal raw material are: 6-7.5% of silicon, 0.3-1.7% of copper, 0.2-2.5% of zinc, 0.4-2.2% of nickel, 0.2-0.7% of magnesium, 0.2-1.3% of iron, with the balance of aluminum;

A method for preparing the semisolid slurry by the pulper comprises the steps of: keeping the temperature of the liquid metal raw material in the holding furnace 12° C. to 23° C. higher than its liquidus; placing the molten metal raw material in the holding furnace into a ladle by the pulper, then placing a solid metal modifier into the ladle, and the metal modifier in the ladle being melted after absorbing the heat of the liquid metal raw material, thus to cool the liquid metal raw material and generate a large number of crystal nuclei, to obtain the semisolid slurry; and blowing, at a speed of 13 L/min, argon gas into the metal raw material in the ladle while adding the metal modifier, to accelerate mixing and cooling, where the dosage of the metal modifier is 1.8% of the mass of the metal raw material in the ladle;

The metal modifier comprises the following components: silicon, copper, manganese, magnesium, zinc, titanium, lead and aluminum, at a mass ratio of 6.70:0.57:0.007:0.38:0.047:0.08:0.04:92.5;

(4) conveying the semisolid slurry into the mold of the semisolid die-casting machine by the pulper, where the semisolid slurry is fast molded by die-casting more easily because the temperature thereof is lower than that of the molten metal slurry, therefore, the temperature of the semisolid slurry after being molded by die-casting is relatively low, and the die-cast, when extracted out of the mold, is of a certain mechanical strength and will not deform when extracted out of the mold due to an excessively high temperature which would cause its shape to be changed, so that the surface smoothness and accuracy specification of the die-cast products are guaranteed, no manual polishing in the subsequent processing is required to reshaping the products;

(5) die-casting by the semisolid die-casting machine, and then opening the mold, extracting the die-cast out of the mold with the extractor, and exporting the die-cast by placing it on the conveyor belt, where the semisolid die-casting machine is a 1000T horizontal cold chamber die-casting machine, with a die-casting temperature of 586° C. to 594° C., a die-casting speed of 4.2 m/s, a system pressure of 15.5 MPa, and a boost pressure of 29 MPa; and (6) conveying the die-cast to the operating bench by the conveyor belt, and stamping to remove the sprue on the die-cast by the oil press to obtain the final die-cast product.

Three die-cast products are randomly sampled from the aluminum alloy die-cast products prepared in the Example 1, and then tested in terms of performance. The test results are as shown in Table 1. The specific test method includes the following steps.

(1) Mechanical properties: a standard sample with a diameter of 10 mm is tested at room temperature by using a tensile testing machine by a room temperature tensile test method (GB/T228.1). The specific test results are as shown in Table 1.

(2) Heat-conductivity properties: the heat-diffusivity is tested by an LFA447Nanoflash instrument (a flash heat-conductivity analyzer) in accordance with ASTME1461 Standard; and the specific heat capacity is tested by power-compensated differential scanning calorimetry DSC8000.

Heat-conductivity=heat-diffusivity*specific heat capacity*density; and the test results are as shown in Table 1.

(3) Planarity: Z-coordinates of 14 points on a plane are tested by a three-coordinate test instrument to obtain the planarity data. The test results are as shown in Table 1.

TABLE 1

| Items | | Die-cast 1 | Die-cast 2 | Die-cast 3 |
|---|---|---|---|---|
| Mechanical properties | Tensile strength MPa | 182.3 | 164.6 | 175.7 |
| | Break elongation % | 5.1 | 5.7 | 5.3 |
| Heat-conducting performance | Heat-conductivity W/(m · k) | 145.3 | 152.5 | 147.1 |
| Planarity | Planarity of die-casting plane mm | 0.31/(420 * 220) | 0.30/(420 * 220) | 0.30/(420 * 220) |

It can be seen from the test data in Table 1 that the product obtained in the Example 1 of the present invention has preferable mechanical properties, heat-conductivity and planarity, with excellent mechanical strength, very good planarity, and leading product performance compared with similar die-cast products.

Finally, it should be noted that: obviously, the above Examples are merely examples provided for clearly illustrating the present invention, but not for limiting the embodiments. For a person of ordinary skill in the art, variations or modifications in other different forms may be made on the basis of the above illustration. It is neither necessary nor able to exhaustively list all of the embodiments. All obvious variations or modifications derived accordingly should be regarded as falling into the protection scope of the present invention.

The above description is merely a preferred example of the present invention, and certainly not for limiting the protection scope of the present invention. Therefore, the equivalent variations made in accordance with the claims of the present invention are still within the protection scope of the present invention.

INDUSTRIAL APPLICABILITY (1) With regard to the die-casting process method for die-cast molding of semisolid metal of the present invention, by die-casting of the semisolid slurry, the die-cast product is compact interiorly, without any pores formed, and the best interior structure and mechanical properties of the die-cast product are guaranteed, and the quality of the product is guaranteed.

(2) With regard to the die-casting process method for die-cast molding of semisolid metal of the present invention, by die-casting of the semisolid slurry, compared with the traditional high-speed high-pressure injection molding process, the die-cast, when extracted out of the mold, is lower in temperature, and the die-cast blank, when extracted out of the mold, has a certain mechanical strength. In contrast, a die-cast, prepared by the traditional liquid die-casting processes, when extracted out of the mold, has a higher temperature and is likely to deform when extracted out of the mold. The deformation of the die-cast blank of the present invention is extremely small, and complex surface treatment is not required for the die-cast, so that the best shape and surface smoothness of the product can be guaranteed.

(3) With regard to the die-casting process method for die-cast molding of semisolid metal of the present invention, by a semisolid die-casting process, the die-cast product has many spherical crystals and the die-casting has better mechanical properties.

The invention claimed is:

1. A die-casting process method for die-cast molding of semisolid metal, characterized in that, in the die-casting process method, a semisolid die-casting machine is used as the processing device, and a pulper is used as the device for preparing and delivering semisolid slurry; the device layout of the die-casting process method is as follows: the pulper is arranged on the left side of the semisolid die-casting machine, a sprayer configured to spray mold release agent to a mold is arranged on the right side of the semisolid die-casting machine, and an extractor configured to extract a die-cast out of the mold is arranged on the front side of the semisolid die-casting machine, the right side of the extractor is coordinated with a conveyor belt, an operating bench is arranged at the right end of the conveyor belt, and an oil press configured to stamp to remove a sprue on the die-cast is provided on the operating bench; and the die-casting process method comprises the steps of:

(1) mounting the mold on the semisolid die-casting machine, spraying the mold release agent onto the surface of the mold with the sprayer, and then closing the mold;

(2) melting metal raw material with a heating furnace, and putting the liquid metal raw material into a holding furnace for storage, wherein the metal raw material is a metal raw material of aluminum alloy;

(3) preparing semisolid slurry from the liquid metal raw material in the holding furnace by the pulper, wherein mass percentages of the components in the liquid metal raw material are: 6-7.5% of silicon, 0.3-1.7% of copper, 0.2-2.5% of zinc, 0.4-2.2% of nickel, 0.2-0.7% of magnesium, 0.2-1.3% of iron, with the balance of aluminum;

(4) conveying the semisolid slurry into the mold of the semisolid die-casting machine by the pulper;

(5) die-casting by the semisolid die-casting machine, and then opening the mold, extracting the die-cast out of the mold with the extractor, and exporting the die-cast by placing it on the conveyor belt, wherein the semisolid die-casting machine is a 1000T horizontal cold chamber die-casting machine, with a die-casting temperature of 586° C. to 594° C., a die-casting speed of 4.2 m/s, a system pressure of 15.5 MPa, and a boost pressure of 29 MPa; and (6) conveying the die-cast to the operating bench by the conveyor belt, and stamping to remove the sprue on the die-cast by the oil press to obtain the final die-cast product.

2. The die-casting process method according to claim 1, characterized in that, in the step (3), a method for preparing the semisolid slurry by the pulper comprises the steps of: keeping the temperature of the liquid metal raw material in the holding furnace 12° C. to 23° C. higher than its liquidus;

placing the molten metal raw material in the holding furnace into a ladle by the pulper, then placing a solid metal modifier into the ladle, and the metal modifier in the ladle being melted after absorbing the heat of the liquid metal raw material, thus to cool the liquid metal raw material and generate a large number of crystal nuclei, to obtain the semisolid slurry; and blowing, at a speed of 13 L/min, argon gas into the metal raw material in the ladle while adding the metal modifier, to accelerate mixing and cooling, wherein the dosage of the metal modifier is 1.5% to 3.8% of the mass of the metal raw material in the ladle.

3. The die-casting process method according to claim 2, characterized in that, the components of the metal modifier are the same as those of the liquid metal raw material.

4. The die-casting process method according to claim 2, characterized in that, the metal modifier comprises the following components: silicon, copper, manganese, magnesium, zinc, titanium, lead and aluminum, at a mass ratio of (6.55 to 6.90):(0.22 to 0.85):(0.003 to 0.008):(0.15 to 0.75):(0.03 to 0.075):(0.06 to 0.1):(0.03 to 0.05):(91.7 to 92.8).

5. The die-casting process method according to claim 4, characterized in that, the metal modifier comprises the following components: silicon, copper, manganese, magnesium, zinc, titanium, lead and aluminum, at a mass ratio of 6.70:0.57:0.007:0.38:0.047:0.08:0.04:92.5.

* * * * *